US007125353B2

(12) United States Patent
Blount

(10) Patent No.: US 7,125,353 B2
(45) Date of Patent: Oct. 24, 2006

(54) BASEBALL BAT GRIP

(76) Inventor: Michael D. Blount, 8926 W. 101st, Overland Park, KS (US) 66210

( * ) Notice: Subject to any disclaimer, the term of this patent is extended or adjusted under 35 U.S.C. 154(b) by 167 days.

(21) Appl. No.: 10/696,187

(22) Filed: Oct. 29, 2003

(65) Prior Publication Data

US 2005/0202910 A1 Sep. 15, 2005

(51) Int. Cl.
*A63B 59/06* (2006.01)
*A63B 53/14* (2006.01)

(52) U.S. Cl. ..... 473/568; 473/302

(58) Field of Classification Search ..... 473/300–303, 473/564–568, 457, 514, 520
See application file for complete search history.

(56) References Cited

U.S. PATENT DOCUMENTS 2,091,458 A * 8/1937 Sleight ..... 16/421
3,084,938 A * 4/1963 Kapanowski ..... 16/421
4,072,311 A * 2/1978 Bertucci ..... 473/551
4,376,536 A 3/1983 Martin
4,511,147 A 4/1985 Olsen
4,653,754 A 3/1987 Cross
4,848,746 A * 7/1989 Klink ..... 473/551
5,184,815 A 2/1993 Maddox
5,217,380 A 6/1993 Martinet
5,419,563 A 5/1995 Abrams et al.
5,431,395 A 7/1995 Ganger, Sr.
5,480,146 A 1/1996 Comer
5,482,270 A 1/1996 Smith
5,806,091 A 9/1998 McHugh
5,839,983 A 11/1998 Kramer
6,110,054 A 8/2000 Rodarte
6,305,051 B1 * 10/2001 Cho ..... 16/430

* cited by examiner

*Primary Examiner*—Mark S. Graham
(74) *Attorney, Agent, or Firm*—Lathrop & Gage LC

(57) ABSTRACT

Disclosed is a baseball bat grip which encourages a user to maintain an appropriate grip throughout a swing. The grip has two protrusions which each fit between the V-shaped opening between the user's index finger and thumb on each hand. The grip also has ridges and valleys which receive the user's fingers to further maintain an appropriate grip.

2 Claims, 1 Drawing Sheet

BASEBALL BAT GRIP

BACKGROUND OF THE INVENTION

1. Field of the Invention

The invention relates primarily to the field of sporting equipment. More specifically, the invention relates to the technological area of the development of baseball bat grips—especially baseball bat grips which are used as training devices.

2. Description of the Related Art

It has been known in the art to comprise baseball grips of a material which enhances the user's hold on the bat, e.g., rubber or neoprene materials. Grips have even been formed such that they better conform to the hands of the user. Some grips even have indentions for receiving the user's fingers in such a way that the bat is more easily gripped. However, none of the grips existing in the prior art adequately address problems overcome by the present invention.

Looking to the unrelated field of invention for golf club grips, reveals that, they have been configured so as to force a finger placement of the user for training purposes, or to enhance actual play. See for example, U.S. Pat. No. 5,480,146 issued to Comer.

None of the grips of the prior art, however adequately train the user to maintain what is called a "knocked knuckles" grip throughout a proper baseball swing. During the proper swing of a baseball bat, the user's knuckles are to be maintained in alignment. The concept seems easy enough to execute. Almost all players, even youth, are able to visually line up the knuckles, and raise the bat in anticipation of a pitched ball. The problem arises once the pitch is delivered, and the batter begins the mechanics of executing a swing. Under these circumstances, the user typically becomes excited, and tightens his or her grip on the bat in order to hit the ball harder. This instinctual response of "trying to kill it," however will result in an improper swing. One reason for this is that when the grip is made more tightly, the knuckles will shift out of their original, aligned position. The tight grip and skewed knuckles will result in an erratic swing that is not level, as is desired.

There is a need in the art for a training device that will force the user to maintain a knocked knuckles alignment, and at the same time grip the bat more lightly throughout the swing.

SUMMARY OF THE INVENTION

The baseball bat of the present invention solves these prior art problems by creating a bat that forces the user to maintain a knocked knuckles alignment during the swing and consequently grip the bat more lightly. This is done by creating a pair of protrusions on the side of the grip opposite the knuckles during a normal swing, these protrusions being especially configured so that they conform to the V-shaped opening formed between the user's thumb and pointer finger part of the hand existing when an appropriate knocked knuckles grip is made on the bat.

In one embodiment of the present invention, these protrusions will be shaped such that they have V-shaped lower portions. Further, the protrusions may have a rough diamond shape.

The grip may also have a plurality of ridges and valleys which serve to receive the user's fingers, and work in conjunction with the protrusions to further maintain proper position during the swing.

DETAILED DESCRIPTION OF THE INVENTION

The baseball bat of the present invention is shown in FIGS. 1–4. A first embodiment of the present invention adapted for use by a right-handed batter is shown. The user is shown properly gripping the bat with right and left hands, the right hand clasping the upper part of the grip, while the left hand grips the lower part of the grip. And upper protrusion 20 and lower protrusion 22 are exposed in the figure. Upper protrusion 20 is received by the V-shaped area 40 between the thumb and pointer finger of the user's right hand. Likewise, protrusion 22 is seen disposed in a second V-shaped portion 42 defined by the area between the user's thumb and pointer finger of the left hand.

Figure 2:
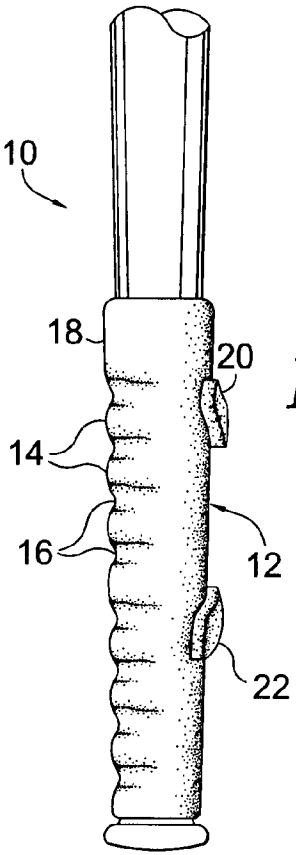
FIG. 2 is a prospective view revealing the protrusions and ridges and valleys of the grip.
Figure 1:
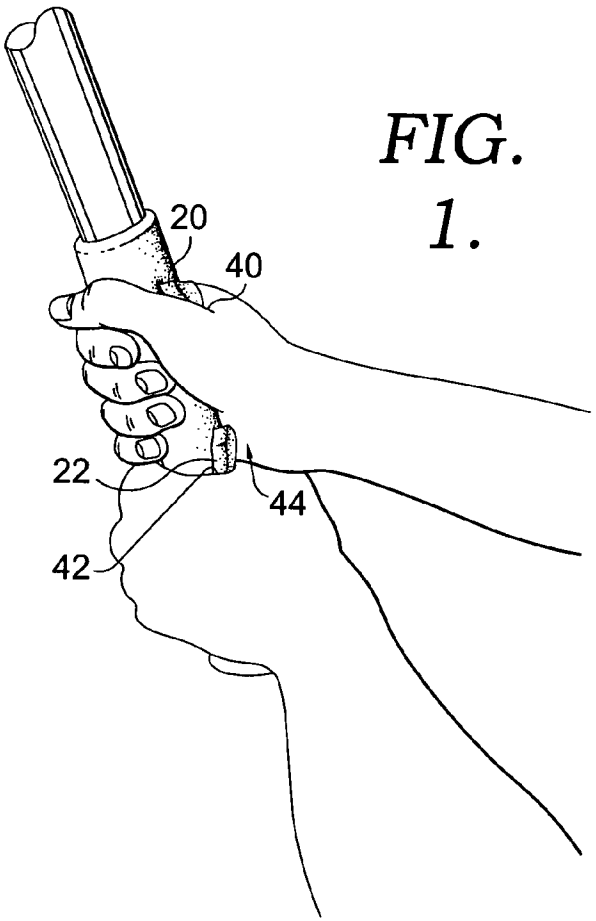
FIG. 1 is a prospective view of the present invention in use by a batter using the proper knocked knuckles grip.

The details of the grip are shown in FIG. 2. As may be seen in the figure, the grip 12 is disposed on a bat 10 as an attached feature by the manufacturer. Other means of forming the grip, however, which still fall within the scope of the present invention. For example, the grip could be formed integrally with the same material of which the bat is comprised. Grip 12 may be used with either metal or wooden type bats. In terms of its composition, the grip shown here is composed of rubber for gripability and ease of manufacture. Other materials, however, could be used as well and still fall within the scope of the present invention. For example, the grip could be manufactured of neoprene or some other kind of like material. Further, the grip could actually be molded with material placed on the bat end and then formed into its desired shape. None of these above materials or processes are critical to the invention, and other materials and/or methods of manufacture could be used and still fall within the scope of the invention.

We will now discuss the details of the grip, as shown in FIG. 2. Grip 12 comprises a plateau portion 18, a plurality of ridges 14 and valleys 16, top protrusion 20 and bottom protrusion 22. As can be seen in the figure, protrusions 20 and 22, are on opposite sides of grip 12 from ridges 14 and valleys 16. This is so when the user engages protrusion 20 with V-shaped section of the right hand 40, and protrusion 22 with V-shaped opening 42 on the left hand, each of the user's ten fingers may be received in a particular valley 16 so that an appropriate grip may be made.

Figure 3:
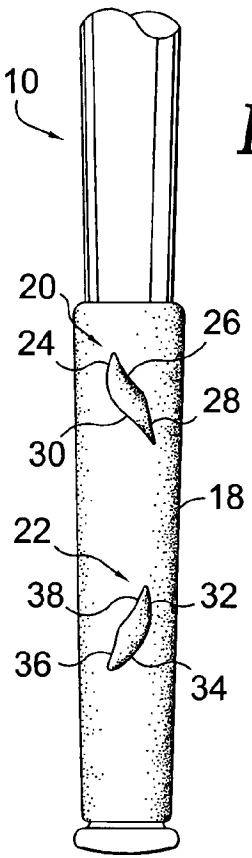
FIG. 3 is a top view showing the outline of the upper and lower protrusions.

FIG. 3 shows the details of first upper 20 and lower 22 protrusions. With respect to upper protrusion, it may be seen that it has a rough-diamond shape with four borders. Upper right border 26 slopes more dramatically downward than outward. Lower right border 28 slopes more dramatically from up to down than from right to left. Bottom left border 30 also slopes more dramatically from up to down than from left to right. Upper left border 32 completes the diamond shape by sloping dramatically from down to up but less so from left to right.

Referring again to FIG. 3, it may be seen that lower protrusion 22 has a somewhat similar appearance to that of upper protrusion 20. Protrusion 22 has an upper right border 32, lower right border 34, lower left border 36 and upper left border 38. Like upper protrusion 20, protrusion 28 also defines a rough-diamond shape.

It is important to note, that though protrusions 20 and 22 have been described as having a diamond shape, the important functional aspect of these features is that they maintain the hands in their prescribed position on the bat even when a user will try to grip the bat harder in making a swing out of pitched ball. It will become clear to one skilled in the art, that numerous other configurations might be able to accomplish the same end with different configurations. These other configurations, of course, would also fall within the scope of this invention, and the present invention is not limited to protrusions having any particular shape.

Also evident is that we skilled in the art would also be able to form a grip falling within the scope of this invention using a moldable or castable material. This material would simply be disposed on the grip end of the bat, a user would make an appropriate grip on the bat into the material, and the material would be hardened to consequently form the protrusions, ridges, and valleys.

It will also be noted that though borders 26, 28, 30, 32, 34, 36, and 38 have been described as linear, that their actual shape is not so. These borders, 26, 28, 30, 32, 34, 36, and 38, instead, have a nonlinear design. They are actually designed to conform to the average user's dimensions of their V-shaped portions 40 and 42. It will be seen that the most important borders are the lower ones, 28, 30 on the right hand protrusion 20, and borders 34 and 36 on the left hand, lower protrusion 22. Borders 28 and 30 are adapted to conform nearly exactly to the V-shaped portion 40, whereas borders 34 and 36 likewise are adapted to conform to V-shaped portion 42. The border 32 on the lower protrusion 22 is also significant in that it is conformed to receive the user's right hand palm portion 44. This border 32, along with V-shaped portion engaging borders 28, 30, 34, and 36 all serve to lock the user's hands properly in place on bat 10 throughout an appropriate swing.

Though the depicted embodiment is one for a right-handed batter, one skilled in the art will discern that the aforementioned principals could be reversed to create a bat designed for a left-handed individual. This would simply comprise reversing the dimensions of protrusions 20 and 22 to conform to the V-shaped portions and palm positions for an appropriate left handed grip.

It will be evident to one skilled in the art that numerous modifications and other embodiments could be constructed that would be different from that which is herein described and depicted, but that would still fall within the scope of this invention. Thus, this disclosure is not intended to be so limiting, but rather illustrative, of one embodiment of the present invention. The scope of the invention is disclosed in the following claims.

The invention claimed is:

1. A baseball grip for use on a bat, said grip comprising:

a first protrusion adapted to be received between a thumb and an index finger on a user's first hand and lock said first hand in place so that said first hand will not shift when a swing is made;

a second protrusion adapted to be received between a thumb and an index finger on a second hand of said user to lock said second hand in place so that said second hand will not shift when said swing is made;

a lower portion of said second protrusion is pointing down the bat at a first acute angle to an axis of the bat;

a lower portion of said first protrusion is pointing down the bat at a second acute angle in an opposite angular direction to said first acute angle and;

said first and second protrusions being on the same side of the bat such that they cause the user to maintain a knocked-knuckles grip during said swing.

2. The grip of claim 1 wherein said first and second protrusions are in an alignment which causes a first V-shaped portion on said user's first hand to be in a position which is in substantial alignment with a second V-shaped portion on said user's second hand during a swing.

* * * * *